US011413731B2

(12) United States Patent
Banholzer

(10) Patent No.: US 11,413,731 B2
(45) Date of Patent: Aug. 16, 2022

(54) POWERED RATCHET WRENCH

(71) Applicant: MILWAUKEE ELECTRIC TOOL CORPORATION, Brookfield, WI (US)

(72) Inventor: Hans T. Banholzer, Milwaukee, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 272 days.

(21) Appl. No.: 16/897,364

(22) Filed: Jun. 10, 2020

(65) Prior Publication Data

US 2020/0391358 A1 Dec. 17, 2020

Related U.S. Application Data

(60) Provisional application No. 62/860,348, filed on Jun. 12, 2019.

(51) Int. Cl.
*B25B 21/00* (2006.01)
*B25B 13/46* (2006.01)

(52) U.S. Cl.
CPC ..... *B25B 21/004* (2013.01); *B25B 13/465* (2013.01); *B25B 13/467* (2013.01)

(58) Field of Classification Search
CPC ..... B25B 21/004; B25B 21/00; B25B 13/465; B25B 13/467
See application file for complete search history.

(56) References Cited

U.S. PATENT DOCUMENTS

| | | | |
|---|---|---|---|
| 685,698 | A | 10/1901 | Sprague |
| 951,056 | A | 3/1910 | Clark |
| 2,851,914 | A | 9/1958 | Zeckzer |
| 2,982,161 | A | 5/1961 | Angquist et al. |
| 3,295,262 | A | 1/1967 | Brown |
| 3,372,612 | A | 3/1968 | Rozmus |
| 3,467,231 | A | 9/1969 | Haznar |
| 3,642,389 | A | 2/1972 | Chambers et al. |
| 3,935,909 | A | 2/1976 | Mabuchi et al. |
| 4,277,989 | A | 7/1981 | Tracy |
| 4,722,253 | A | 2/1988 | Chow |
| 4,807,500 | A | 2/1989 | Main |
| 5,009,132 | A | 4/1991 | Gilberto |
| 5,144,869 | A | 9/1992 | Chow |

(Continued)

FOREIGN PATENT DOCUMENTS

| | | | |
|---|---|---|---|
| DE | 202015105924 | U1 | 11/2015 |
| EP | 0431278 | A2 | 6/1991 |

*Primary Examiner* — David B. Thomas
(74) *Attorney, Agent, or Firm* — Michael Best & Friedrich LLP

(57) ABSTRACT

A power tool includes a motor and an output assembly configured to receive torque from the motor. The output assembly includes an anvil having a cylindrical body portion, an output member configured to engage a socket, and a curvilinear transition portion that tapers between the body portion and the output member. The transition portion defines a radius in a plane containing a rotational axis of the anvil that is greater than 1.5 mm. The output assembly also includes a pawl that is moveable between a first position in which the pawl is operatively coupled to drive the anvil in a first direction and a second position in which the pawl is operatively coupled to drive the anvil in a second direction opposite the first direction.

4 Claims, 8 Drawing Sheets

(56) References Cited

U.S. PATENT DOCUMENTS

| | | | |
|---|---|---|---|
| 5,537,899 | A | 7/1996 | Diedrich |
| 5,622,089 | A | 4/1997 | Gifford, Sr. |
| 5,832,791 | A | 11/1998 | Lin |
| 5,967,243 | A | 10/1999 | Jacobsson |
| 5,983,757 | A | 11/1999 | Blise et al. |
| 6,205,891 | B1 | 3/2001 | Huang et al. |
| 6,209,422 | B1 | 4/2001 | Kamiya et al. |
| 6,311,584 | B1 | 11/2001 | Chu |
| 6,457,386 | B1 | 10/2002 | Chiang |
| 6,530,436 | B2 | 3/2003 | Nowak et al. |
| 6,578,643 | B2 | 6/2003 | Izumisawa |
| 6,681,660 | B2 | 1/2004 | Foard |
| 6,712,157 | B2 | 3/2004 | Hansson |
| 6,715,380 | B2 | 4/2004 | Listl et al. |
| 6,769,330 | B2 | 8/2004 | Chang |
| 6,785,971 | B2 | 9/2004 | McDonnell |
| 6,871,711 | B2 | 3/2005 | Hansson |
| 6,915,721 | B2 | 7/2005 | Hsu et al. |
| 6,923,095 | B2 | 8/2005 | Horvath |
| 7,059,217 | B2 | 6/2006 | Horvath |
| 7,069,819 | B2 | 7/2006 | Albertson et al. |
| 7,082,860 | B2 | 8/2006 | Shu-Sui et al. |
| 7,131,205 | B2 | 11/2006 | McDonnell |
| 7,168,340 | B1 | 1/2007 | Green |
| 7,171,873 | B2 | 2/2007 | Horvath |
| 7,223,195 | B2 | 5/2007 | Milbourne et al. |
| 7,267,033 | B1 | 9/2007 | Lai |
| 7,284,463 | B2 | 10/2007 | Decelles et al. |
| 7,441,482 | B2 | 10/2008 | Lin |
| 7,452,304 | B2 | 11/2008 | Hagan et al. |
| 7,484,439 | B2 | 2/2009 | Lin |
| 7,536,934 | B1 | 5/2009 | Tatangelo |
| 7,735,398 | B2 | 6/2010 | Hsu et al. |
| 7,770,494 | B2 | 8/2010 | Cornwell et al. |
| 7,793,568 | B2 | 9/2010 | Mitcheltree et al. |
| 7,814,816 | B2 | 10/2010 | Alberti et al. |
| 7,827,886 | B2 | 11/2010 | Hu |
| 7,836,798 | B2 | 11/2010 | Hu |
| 7,896,103 | B2 | 3/2011 | Johnson et al. |
| 7,938,042 | B2 | 5/2011 | Hu |
| 8,051,746 | B2 | 11/2011 | Bouchard et al. |
| 8,205,684 | B2 | 6/2012 | Kokinelis et al. |
| 8,375,828 | B2 | 2/2013 | Chen |
| 8,480,453 | B2 | 7/2013 | Kobayashi |
| 8,485,935 | B2 | 7/2013 | Hecht et al. |
| 8,499,666 | B2 | 8/2013 | Hopper et al. |
| 8,584,555 | B2 | 11/2013 | Chan |
| 8,968,147 | B2 | 3/2015 | Hecht et al. |
| 9,010,509 | B2 | 4/2015 | Kobayashi |
| 9,038,507 | B2 | 5/2015 | Thompson et al. |
| 9,067,309 | B2 | 6/2015 | Mcmenemy |
| 9,120,213 | B2 | 9/2015 | Elger |
| 9,149,917 | B2 | 10/2015 | Beer et al. |
| 9,321,154 | B2 | 4/2016 | Chen et al. |
| 2003/0213340 | A1 | 11/2003 | Alden |
| 2003/0213341 | A1 | 11/2003 | Alden |
| 2005/0039579 | A1 | 2/2005 | Wallace |
| 2005/0284265 | A1 | 12/2005 | Baker |
| 2006/0027048 | A1 | 2/2006 | Chen |
| 2006/0053979 | A1 | 3/2006 | Izumisawa |
| 2006/0236819 | A1 | 10/2006 | Lee |
| 2006/0283265 | A1 | 12/2006 | Izumisawa |
| 2007/0107560 | A1 | 5/2007 | Chiang |
| 2007/0186729 | A1 | 8/2007 | Baker |
| 2008/0083303 | A1 | 4/2008 | Baker |
| 2010/0162857 | A1 | 7/2010 | Chang |
| 2011/0036209 | A1* | 2/2011 | Hung ..... B25B 21/004 81/60 |
| 2012/0186400 | A1 | 7/2012 | Elger |
| 2014/0182420 | A1 | 7/2014 | Chen et al. |
| 2014/0182992 | A1 | 7/2014 | Su |
| 2016/0075002 | A1 | 3/2016 | Hu et al. |
| 2016/0075003 | A1 | 3/2016 | Hu et al. |

* cited by examiner

POWERED RATCHET WRENCH

CROSS-REFERENCE TO RELATED APPLICATIONS

This application claims priority to U.S. Provisional Patent Application No. 62/860,348 filed on Jun. 12, 2019, the entire content of which is incorporated herein by reference.

BACKGROUND

The present disclosure relates to a powered ratchet wrench for applying torque to a fastener for tightening or loosening the fastener.

Powered ratchet tools are typically powered by an electrical source, such as a DC battery, a conventional AC source, or by pressurized air. Powered ratchet tools are constructed of components such as a motor, a drive assembly driven by the motor, and an output for applying torque to a fastener.

SUMMARY

In one aspect of the invention, a power tool comprises a motor and an output assembly configured to receive torque from the motor. The output assembly includes an anvil having a cylindrical body portion, an output member configured to engage a socket, and a curvilinear transition portion that tapers between the body portion and the output member. The transition portion defines a radius in a plane containing a rotational axis of the anvil that is greater than 1.5 mm. The output assembly also includes a pawl that is moveable between a first position in which the pawl is operatively coupled to drive the anvil in a first direction and a second position in which the pawl is operatively coupled to drive the anvil in a second direction opposite the first direction.

Other aspects of the disclosure will become apparent by consideration of the detailed description and accompanying drawings.

Before any constructions of the disclosure are explained in detail, it is to be understood that the disclosure is not limited in its application to the details of construction and the arrangement of components set forth in the following description or illustrated in the following drawings. The disclosure is capable of other constructions and of being practiced or of being carried out in various ways.

DETAILED DESCRIPTION

Figure 1:
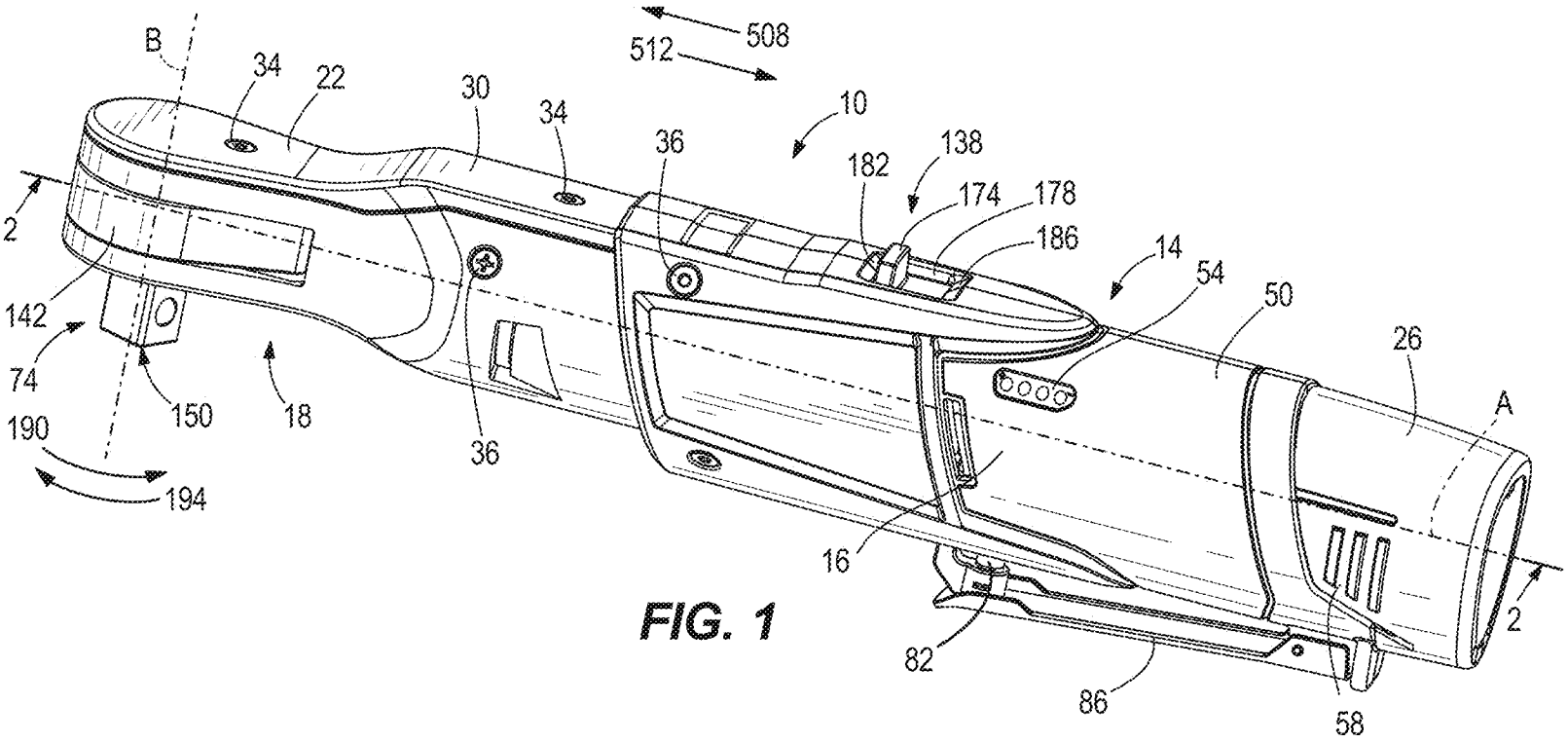
FIG. 1 is a side perspective view of a powered ratchet wrench according to one construction.

FIGS. 1-7 illustrate a battery-powered hand-held ratchet tool 10 according to one construction. The ratchet tool 10 includes a main housing 14, a head housing 18, a head cover plate 22, and a battery pack 26 received by the main housing 14. In other constructions, the ratchet tool 10 may be configured as a hand-held ratcheting torque wrench, such as that disclosed in U.S. patent application Ser. No. 15/703,766 filed Sep. 13, 2017, the entire content of which is incorporated herein by reference. The ratchet tool 10 defines a longitudinal axis A. The head cover plate 22 defines an upper surface 30 of the head housing 18 and is secured to the head housing 18 by fasteners 34 such as Philips head screws or other suitable fasteners. The head housing 18 is preferably nitro-carburized steel and is disposed adjacent the main housing 14. Steel is suitable for reducing flux losses in motors. In other constructions, other metals suitable for reducing flux loss may be employed, e.g., other ferromagnetic materials. The main housing 14 is secured about the outer circumference of an end of the head housing 18 by fasteners 36 (FIG. 1). The main housing 14 extends generally parallel to the axis A. The main housing 14 may have a grip 50 overmolded on a generally tubular surface 16 thereof, or the grip 50 may be integrated with the main housing 14 (e.g., with the generally tubular surface 16 of the main housing 14) in other constructions. The grip 50 may be formed by a resilient material such as rubber or silicone. The battery pack 26 is inserted into a cavity in the main housing 14 in the axial direction of the axis A and snaps into mechanical connection with the main housing 14, thereby also achieving an electrical connection therewith. The main housing 14 includes an indicator 54 that displays a charge level of the battery pack 26. The battery pack 26 includes a latch 58, which can be depressed to release the battery pack 26 from the ratchet tool 10.

The battery pack 26 is a removable and rechargeable 12-volt battery pack and includes three (3) Lithium-ion battery cells. In other constructions, the battery pack may include fewer or more battery cells such that the battery pack is a 14.4-volt battery pack, an 18-volt battery pack, or the like. Additionally or alternatively, the battery cells may have chemistries other than Lithium-ion, such as for example, Nickel Cadmium, Nickel Metal-Hydride, or the like. In other constructions, the ratchet tool 10 includes a cord (not shown) and is powered by a remote source of power, such as an AC utility source connected to the cord. In another construction, the ratchet tool 10 may be a pneumatic tool powered by pressurized air flow through a rotary air vane motor (not shown) and a connector (not shown) for receiving the pressurized air. In other constructions, other power sources may be employed.

Figure 2:
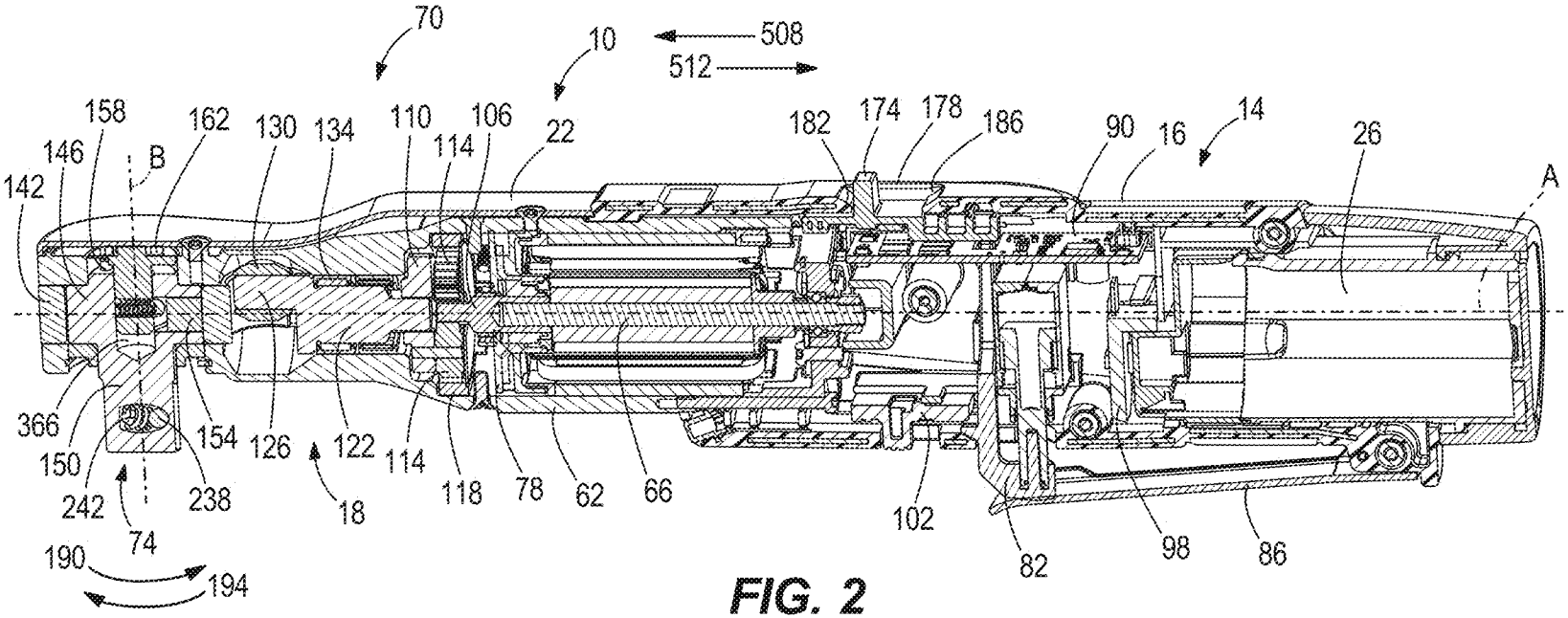
FIG. 2 is cross-section view of the powered ratchet wrench of FIG. 1 taken about the line 2-2 in FIG. 1.

As shown in FIG. 2, the ratchet tool 10 includes a motor 62, a motor drive shaft 66 extending from the motor 62 and centered about the axis A, and a drive assembly 70 coupled to the motor drive shaft 66 for driving an output assembly 74. The motor 62 is mounted to a steel motor plate 78 and received in the head housing 18. The output assembly 74 defines a central axis B substantially perpendicular to the axis A, and will be described in greater detail below. The ratchet tool 10 also includes a switch 82 for selectively connecting the motor 62 to the power source (e.g., the battery pack 26), a switch paddle 86 for actuating the switch 82, a printed circuit board assembly (PCBA) 90, a suppressor (not shown), a battery connector 98 for electrically connecting the battery pack 26 to the motor 62, and a lockout shuttle 102 for selectively blocking the switch 82 from actuation, for example, when the ratchet tool 10 is in storage. The switch paddle 86 is preferably made of metal, is coupled with the main housing 14 and is depressible to actuate the switch 82 when in a depressed position. In other constructions, the switch paddle 86 may be made of plastic or other materials. The switch paddle 86 is biased to a non-depressed position. The switch 82, when actuated, electrically couples the battery pack 26 and the motor 62 to run the motor 62.

As shown in FIG. 2, the drive assembly 70 includes a sun gear 106, a planet carrier or cage 110, three planet gears 114, a ring gear 118, a crankshaft 122 having an eccentric member 126, a drive bushing 130, and two needle bearings 134. The sun gear 106 is coupled to the drive shaft 66 of the motor 62 for rotation therewith. In this construction, the ring gear 118 is fixed and the planet carrier 110 rotates with the planet gears 114 such that the planet gears 114 rotate about respective axes and follow a circular path. The planet gears 114 are driven by toothed engagement with the sun gear 106, which rotates with the drive shaft 66 by fixed engagement therewith. In this construction, the crankshaft 122 is driven by fixed engagement with the planet carrier 110, which transfers rotation thereto. In other constructions, other drive assemblies may be employed.

Figure 3:
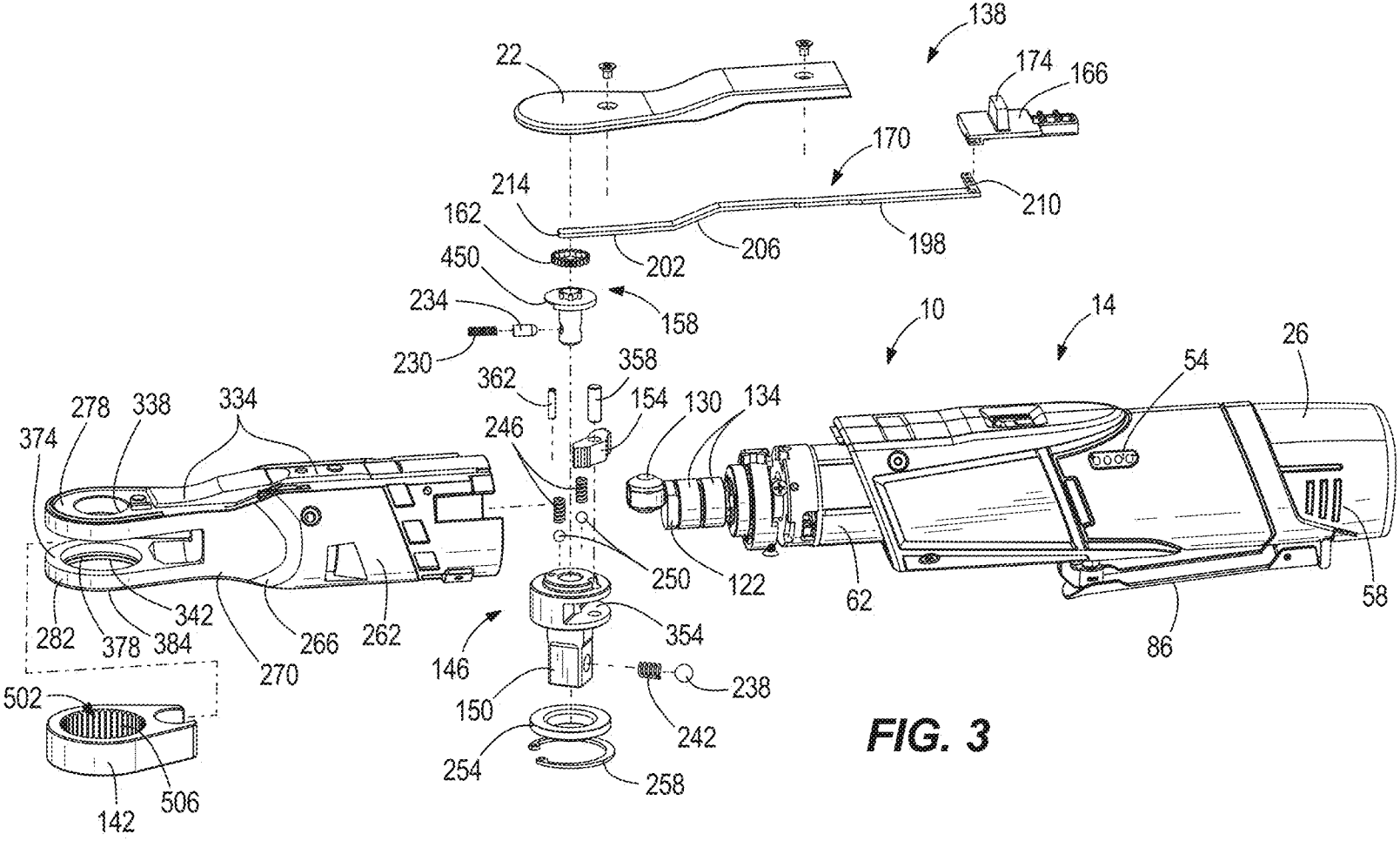
FIG. 3 is an exploded view of the powered ratchet wrench of FIG. 1.
Figure 4:
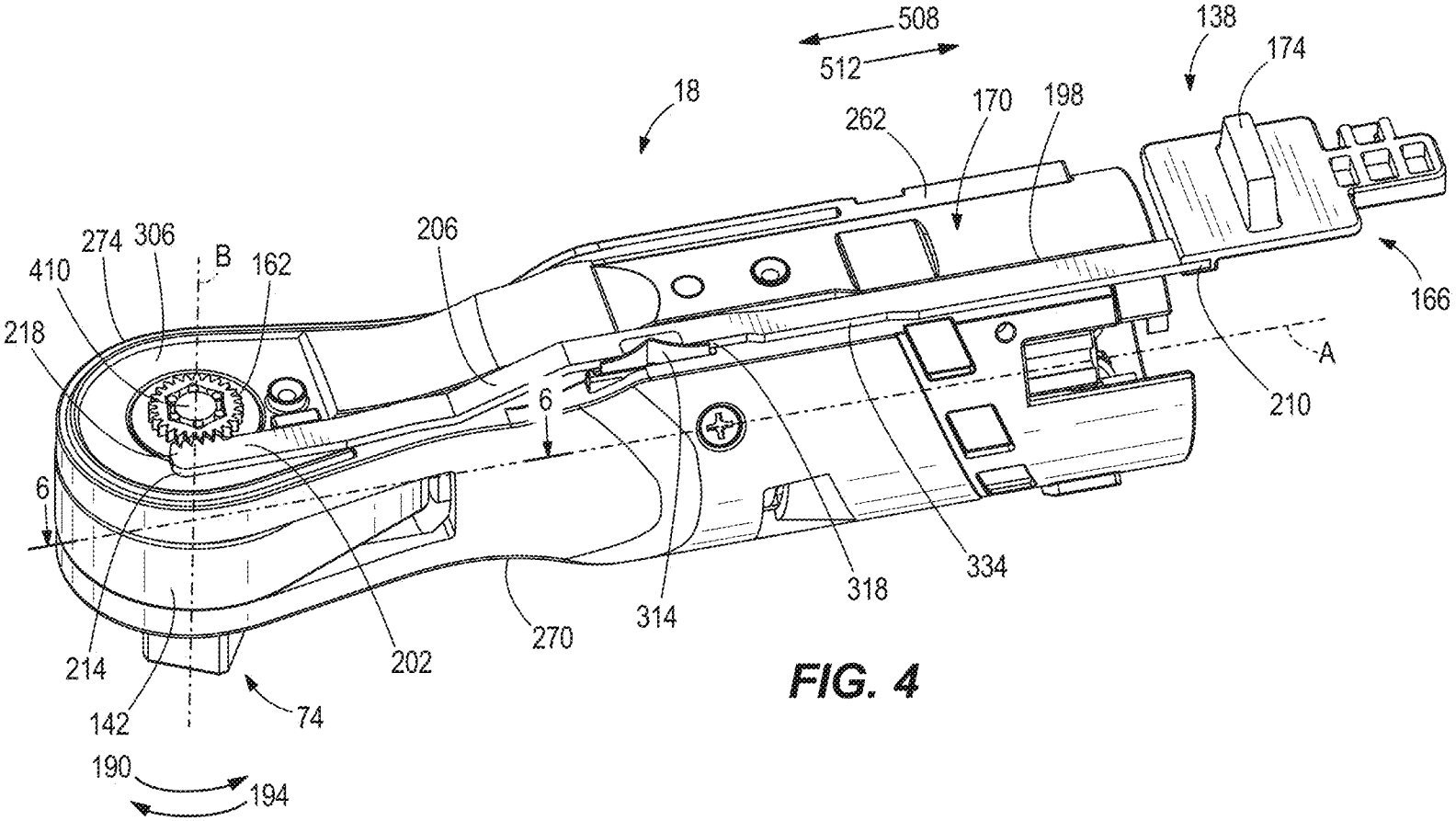
FIG. 4 is a detail view of a portion of the powered ratchet wrench of FIG. 1 with a head cover plate removed.

The output assembly 74 is received in the head housing 18. With reference to FIGS. 3-7, the output assembly 74 includes a forward/reverse switch 138, a yoke 142, an anvil 146 having an output member 150 (FIG. 7), such as a square head, for engaging sockets, a pawl 154 (FIG. 6), a rotational member 158 (FIG. 3), and a switch gear 162 (FIG. 4).

The forward/reverse switch 138 includes a switch actuator 166 (FIG. 3) and a switch slider 170 (FIG. 3), which may also be referred to herein as a linkage. The switch actuator 166 includes a protrusion 174 that extends through an aperture 178 in the generally tubular surface 16 of the main housing 14 for actuation by a user. At least a portion of a surface of the protrusion 174 is disposed outside of, or external to, the main housing 14 such that the protrusion 174 is part of an external surface of the ratchet tool 10, actuatable by the user through direct engagement between the user's body (e.g., hand) and the protrusion 174. As shown in FIG. 2, the switch actuator 166 is slidable between a first position 182 and a second position 186 in either axial direction 508, 512, which are substantially parallel to the longitudinal axis A of the powered ratchet tool 10. The first position 182 corresponds to a first rotational direction 190 of the output member 150 and the second position 186 corresponds to a second rotational direction 194 of the output member 150. As shown in FIG. 4, the switch slider 170 is generally shaped to follow a contour of the head housing 18. The switch slider 170 has a first portion 198 and a second portion 202 that are substantially parallel to the longitudinal axis A. As shown in FIGS. 3-4, the first portion 198 and the second portion 202 are spaced apart with respect to the axis B, or offset. The first portion 198 and the second portion 202 are connected by an intermediate portion 206. The intermediate portion 206 is angled with respect to the first portion 198 and the second portion 202 transverse to the longitudinal axis A. The first portion 198 of the switch slider 170 includes an end 210 engaged with the switch actuator 166. The second portion 202 of the switch slider 170 includes an end 214 having teeth 218. In the illustrated construction, the end 214 of the second portion 202 includes five teeth. In other constructions, different numbers of teeth or different arrangements of teeth may be employed. For example, in some constructions, the teeth 218 may be spaced from the end 214 of the second portion of the switch actuator 166.

Figure 7:
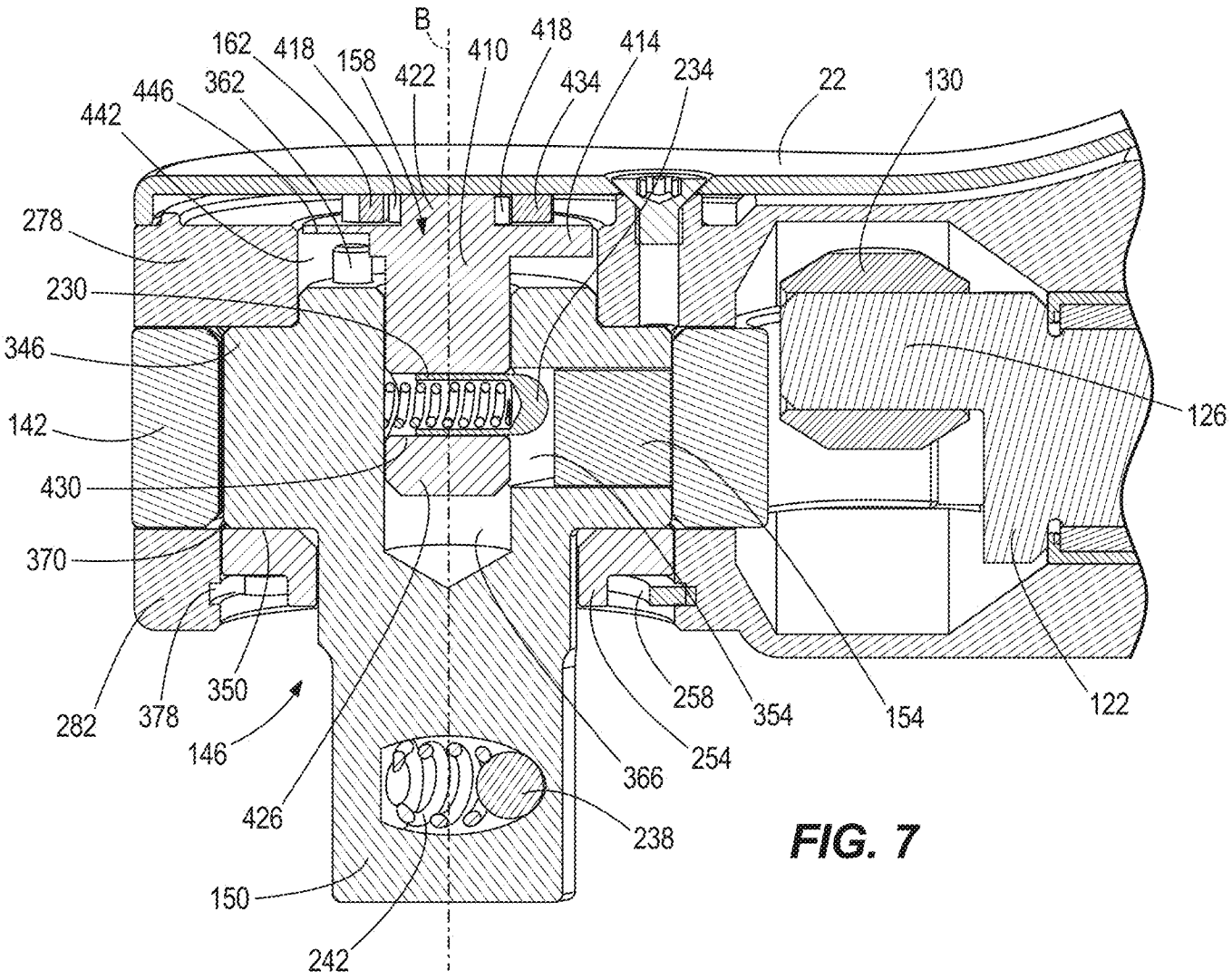
FIG. 7 is another cross-section view of the head of the powered ratchet wrench of FIG. 1 taken along the line 7-7 in FIG. 5.

In the illustrated construction, the output member 150 is a ½ inch output member. In other constructions, the output member 150 may be other sizes such as ⅜ inch, or another suitable size. As best shown in FIG. 7, the yoke 142, the anvil 146, the rotational member 158, and the switch gear 162 are generally centered along the axis B.

The output assembly 74 also includes a steel ball 238 and spring 242 for retaining sockets on the output member 150, two friction springs 246 (FIGS. 3-6) and corresponding friction balls 250, friction plate 254 and retaining ring 258, as will be described in greater detail below. In other constructions, three, four, or more friction springs 246 and corresponding friction balls 250 may be employed.

With reference to FIGS. 2 and 3, the head housing 18 is formed from steel as one piece and includes a cylindrical portion 262 that houses at least a portion of the motor 62, a shoulder portion 266 that houses the drive assembly 70, a substantially square neck portion 270 that houses the crankshaft 122 and eccentric member 126, and a head portion 274 having a first ear 278 and second ear 282 that receive the output assembly 74 and, more specifically, receive the yoke 142. As can best be seen in FIG. 4, a track 334 is formed along a side of the head portion 274. The track 334 receives the switch slider 170. A leaf spring, such as a clip 314 is disposed on the cylindrical portion 262 proximate the neck portion 270. The clip 314 includes a passageway 318 aligned along the track 334 substantially parallel to the longitudinal axis A. The passageway 318 receives the switch slider 170. The track 334 restricts the switch slider 170 to linear motion along the axis A. The clip 314 secures the switch slider 170 within the track 334 and inhibits upward (e.g. toward the head cover plate 22) or downward (e.g. towards the upper surface 30 of the head housing 18) rotation of the switch slider 170 as the switch slider 170 slides along the track 334.

As shown in FIG. 3, the first ear 278 of the head housing 18 includes a first aperture 338 and the second ear 282 of the head housing 18 includes a second aperture 342. The first and second apertures 338, 342 are centered about the axis B. The yoke 142 is received between the first and second ears 278, 282 in a direction perpendicular to axis B. The anvil 146 is received in the first and second apertures 338, 342.

With particular reference to FIGS. 3-4 and 7, the anvil 146 includes an upper surface 346 proximate the first ear 278, a lower surface 350 proximate the second ear 282, a cavity 354, a first pin 358, and a second pin 362. The anvil 146 includes a bore 366 that is generally centered about the axis B. The bore 366 extends inwardly towards the lower surface 350 of the anvil 146. The bore 366 receives the rotational member 158. The lower surface 350 includes a shoulder 370 that abuts an inner surface of the friction plate 254. The inner surface 374 of the second ear 282 faces the first ear 278. The shoulder 370 of the anvil 146 includes an annular recess that receives the retaining ring 258, which is disposed about an outer circumference of the anvil 146. The friction plate 254 abuts a recessed surface 378 of the second ear 282. The recessed surface 378 defines a portion of the second aperture 342. The recessed surface 378 lies in a plane parallel to and disposed in between the inner surface 374 of the second ear 282 and an outer surface 384 of the second ear 282 facing the output member 150 and facing away from the first ear 278. The recessed surface 378 and the outer surface 384 lie parallel to the axis A. The first and second ears 278, 282 generally lie parallel to the axis A. The recessed surface 378 also faces the output member 150 and away from the first ear 278. This configuration secures the anvil 146 rotatably within the head housing 18.

Figure 6:
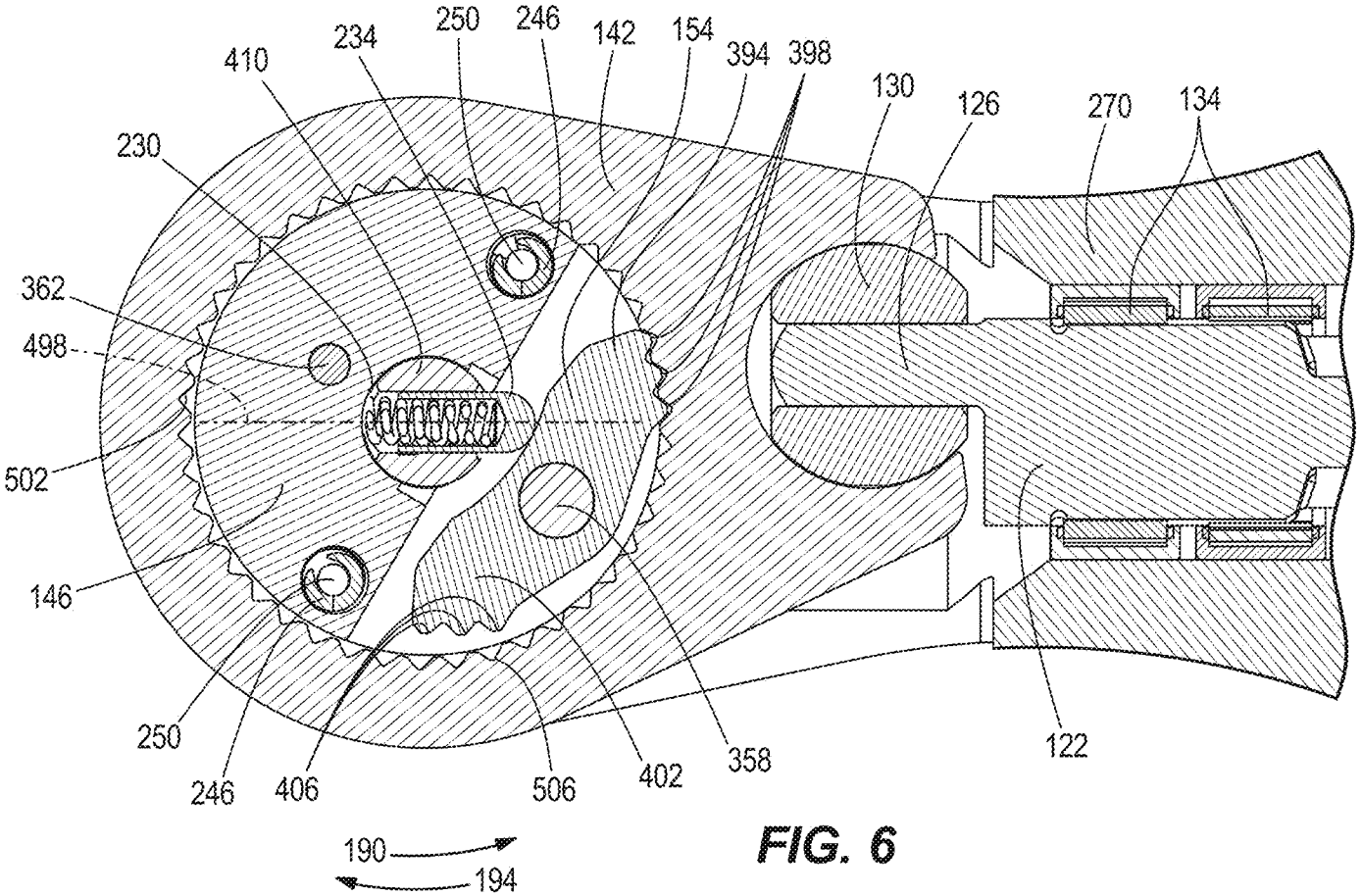
FIG. 6 is a cross-section view of a head of the powered ratchet wrench of FIG. 1 taken along the line 6-6 in FIG. 4.

With reference to FIG. 6, the output assembly 74 includes a single-pawl ratchet design. The pawl 154 is disposed within the cavity 354 and pivotally secured within the cavity 354 by the first pin 358. In the illustrated construction, the first pin 358 extends through an aperture formed at a center of the pawl 154. The pawl 154 includes an angled first end 394 including teeth 398 and an angled second end 402 including teeth 406. An inner diameter 498 of the yoke 142 is defined by an aperture 502 and includes yoke teeth 506. The pawl 154 is pivotable about the first pin 358 so that the first end 394 or the second end 402 selectively engages the yoke 142 in a driving engagement or a ratcheting engagement, which will be described in greater detail below.

As shown in FIG. 7, the rotational member 158 includes a shaft 410 (FIGS. 6 and 7), a planar member 414, and a bearing, such as a plurality of pins 418. The shaft 410 extends longitudinally along the axis B between a first end 422 and a second end 426. The shaft 410 is received within the bore 366 of the anvil 146. An aperture 430 is disposed proximate the second end 426 and extends through the shaft 410 in a direction substantially perpendicular to the axis B. The spring 230 and the spring cap 234 (which may also be referred to herein as a spring-biased member) are disposed within the aperture 430, which may also be referred to herein as a pocket. The planar member 414 is disposed along the shaft 410 proximate and spaced from the first end 422 of the shaft 410. In the illustrated construction, the planar member 414 is circular and has a diameter similar to a diameter of the anvil 146. The planar member 414 is centered about the axis B. The planar member 414 includes an upper surface 434. The plurality of pins 418 is disposed on the upper surface 434 (FIG. 5) of the planar member 414 and disposed circumferentially around the shaft 410. In the illustrated construction, the plurality of pins 418 includes six pins. In alternate constructions, a different number of pins may be employed, other types of bearings (such as a ball bearing, a needle bearing, a bushing, etc.) may be employed, and/or a spindle lock, one-way clutch, sprag clutch, a two-way mechanical lock, etc. may be employed. A cavity 442 extends upward into the planar member 414 and has a first wall 446 (FIG. 7) and a second wall 450 (FIG. 3) spaced from the first wall 446. The second pin 362 is received in the cavity 442. The planar member 414 is rotatable with respect to the anvil 146 between a first position in which the second pin 362 abuts the first wall 446 and a second position in which the second pin 362 abuts the second wall 450.

Figure 5:
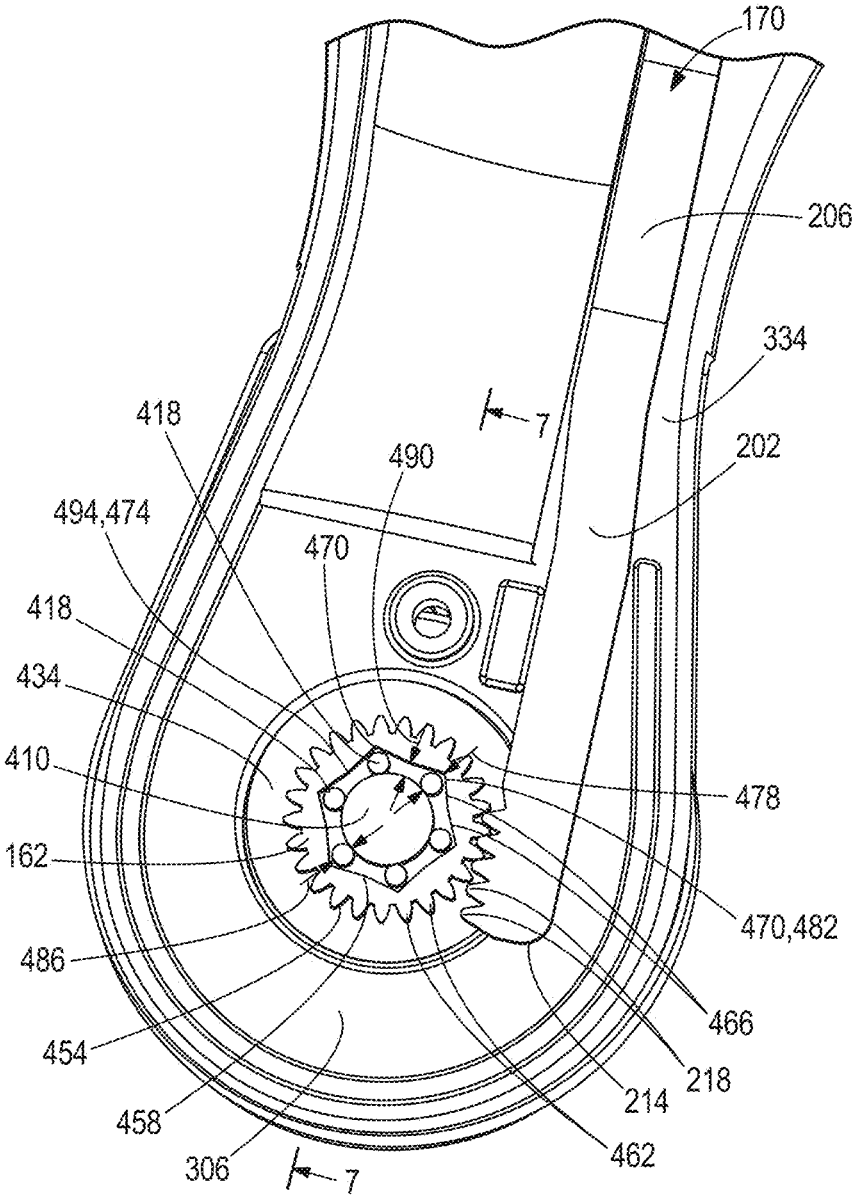
FIG. 5 is a detail view of a head of the powered ratchet wrench of FIG. 1 with the head cover plate removed.

As shown in FIG. 5, the switch gear 162 is annular and includes an outer diameter 454 and an inner diameter 458. The outer diameter 454 includes a plurality of teeth 462. In other constructions, the switch gear 162 may include one tooth, or one or more teeth. The plurality of teeth 462 mesh with the teeth 218 formed at the end 214 of the second portion 202 of the switch slider 170. In the illustrated construction, the inner diameter 458 of the switch gear includes twelve angled side ramps 466 that cooperatively form six outwardly (e.g., towards the outer diameter 454) extending ends 470 and six inwardly (e.g., toward a center of the switch gear 162) extending ends 474. In alternate constructions, the inner diameter may be a different shape or may include a different number of ramps that form a different number of inwardly extending ends and outwardly extending ends. The switch gear 162 is disposed on the upper surface 434 of the planar member 414 so that each of the plurality of pins 418 is received within one of the outwardly extending ends 470. The switch gear 162 is rotatable with respect to the upper surface 434 of the planar member 414. With continued reference to FIG. 5, a radial distance between each of the outwardly extending ends 470 and the shaft 410 of the rotational member 158 is wider than a diameter 486 of the pins 418. A radial distance between each of the plurality of inwardly extending ends 474 and the shaft 410 is smaller than the diameter 486 of the pins 418. Accordingly, when the plurality of pins 418 is disposed adjacent the outwardly extending ends 470, the rotational member 158 is rotatable with respect to the switch gear 162. When the plurality of pins 418 is disposed proximate the inwardly extending ends 474, the rotational member 158 is fixed with respect to the switch gear 162 and may be driven by the switch gear 162.

The spring 230 and the spring cap 234, which are rotatable by the shaft 410 between a first position (shown in FIG. 6) and a second position (not shown), selectively urge the teeth 398 of the pawl 154 or the teeth 406 of the pawl 154 to engage the yoke teeth 506, respectively. In the first position of the shaft 410 (not shown), the yoke teeth 506 mesh with the teeth 406 of the pawl 154 when the yoke 142 moves in a first direction, and the yoke teeth 506 slide with respect to the teeth 406 of the pawl 154 when the yoke 142 moves in a second direction opposite the first direction. In the second position of the shaft 410 (FIG. 6), the yoke teeth 506 mesh with the teeth 398 of the pawl 154 when the yoke 142 moves in the second direction, and the yoke teeth 506 slide with respect to the teeth 398 of the pawl 154 when the yoke 142 moves in the first direction. Thus, only one direction of motion is transferred from the yoke 142 to the output member 150. The rotational member 158 is operatively coupled to the spring 230 and the spring cap 234 to orient the pawl 154 with respect to the first pin 358 such that the opposite direction of motion is transferred from the yoke 142 to the output member 150 when the forward/reverse switch 138 is repositioned.

In operation, the operator actuates the switch paddle 86, which activates the motor 62 to provide torque to the output member 150. The yoke 142 is oscillated about the axis B by the eccentric member 126.

The user pushes the forward/reverse switch 138 in a first direction 508 (e.g., forward) to provide the torque in the first direction 190. As the forward/reverse switch 138 and the switch slider 170 move in the first direction 508, the teeth 218 at the end 214 of the switch slider 170, which are in engagement with the teeth 462 of the switch gear 162, rotate the switch gear 162 as shown by the arrow 194 (FIG. 4). As the switch gear 162 rotates, the inwardly extending ends 474 are wedged against the pins 418. As the switch gear 162 continues to rotate, the switch gear 162 drives the pins 418 in the direction 194 to rotate the rotational member 158 in the direction 194. As the rotational member 158 rotates, the spring 230 and the spring cap 234 cooperate to urge the pawl 154 to the first position (not shown). In the first position, the output member 150 is configured to be driven in the direction 190. When the motor is running, the output member 150 can be driven in isolation from the switch gear 162. In other words, the switch gear 162 is not driven by the output member 150. Thus, the teeth 218 can remain in engagement with the switch gear 162 at all times, even when the output member 150 is rotating.

When the forward/reverse switch 138 is in the first position 182, the teeth 406 engage the teeth 506 of the yoke 142. The teeth 406 drivingly mesh with the teeth 506 of the yoke 142 when the yoke 142 rotates in the first direction 190 and slide, or ratchet, with respect to the teeth 398 when the yoke 142 rotates in the second direction 194 opposite the second direction. Thus, when the forward/reverse switch 138 is in the first position 182, the output member 150 is driven to rotate only in a single direction, e.g., the first direction 190.

To operate the output member 150 in the second direction 194, the user pushes the forward/reverse switch 138 in a second direction 512. As the forward/reverse switch 138 and the switch slider 170 move in the second direction 512, the teeth 218 at the end 214 of the switch slider 170 engage the teeth of the switch gear 162 and rotate the switch gear 162 as shown by the arrow 190. As the switch gear 162 rotates, the inwardly extending ends 474 are wedged against the pins 418. As the switch gear 162 continues to rotate, the switch gear 162 drives the pins 418, and therefore the rotational member 158 in the direction 190. As the rotational member 158 rotates, the spring 230 and the spring cap 234 cooperate to urge the pawl 154 to the second position (FIG. 6), in which the teeth 398 of the pawl 154 are in driven engagement with the teeth 506 of the yoke 142. When the motor is running, the output member 150 can be driven in isolation from the switch gear 162, as discussed above.

When the forward/reverse switch 138 is in the second position 186, the teeth 398 engage the teeth 506 of the yoke 142. In the second position, the teeth 398 drivingly mesh with the teeth 506 of the yoke 142 when the yoke 142 rotates in the second direction 194 and slide, or ratchet, with respect to the teeth 406 when the yoke 142 rotates in the first direction 190. Thus, when the forward/reverse switch 138 is in the second position 186, the output member 150 rotates only in a single direction opposite from when the forward/reverse switch 138 is in the first position (e.g., the second direction 194).

Figure 8:
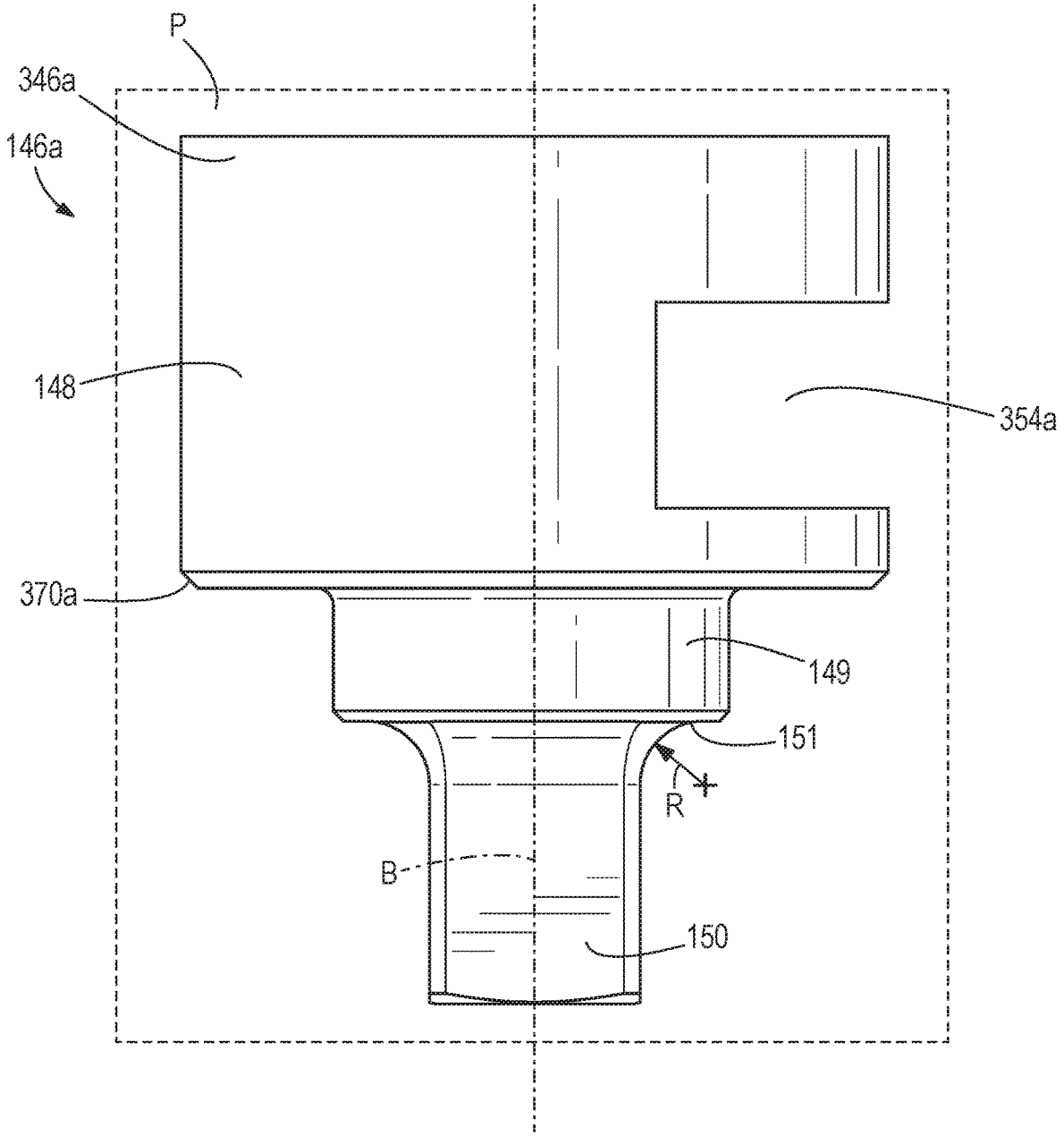
FIG. 8 is a plan view of an anvil of the powered ratchet wrench according to another construction.

FIG. 8 illustrates another embodiment of the anvil 146, with like parts labeled with like reference numerals plus the letter "a," and differences explained below. The anvil **146*a* of the embodiment of FIG. 8 includes an upper body portion 148, a lower, cylindrical body portion 149, and a curvilinear transition portion 151 that tapers as it extends between the cylindrical body portion 149 and the output member 150*a*. Specifically, the transition portion 151 tapers as it extends from the cylindrical body portion 149 to the output member 150*a*. The transition portion 151 defines a radius R in a plane P containing the central axis B. In some embodiments the radius R is greater than 1.5 mm. In some embodiment, the radius R is greater than 1.8 mm. In some embodiments, the radius R is greater than or equal to 1.9 mm. In some embodiment, the radius R is 1.9 mm. By selecting the radius R to be 1.5 mm or greater, the durability and longevity of the anvil 146*a*** is greatly improved.

Various features of the invention are set forth in the following claims.

What is claimed is:

1. A power tool comprising:

a motor;

an output assembly configured to receive torque from the motor, the output assembly including an anvil having a cylindrical body portion, an output member configured to engage a socket, and a curvilinear transition portion that tapers between the body portion and the output member, the transition portion defining a radius in a plane containing a rotational axis of the anvil that is greater than 1.5 mm, and a pawl that is moveable between a first position in which the pawl is operatively coupled to drive the anvil in a first direction and a second position in which the pawl is operatively coupled to drive the anvil in a second direction opposite the first direction.

2. The power tool of claim 1, wherein the radius of the transition portion is greater than 1.8 mm.

3. The power tool of claim 2, wherein the radius of the transition portion is greater than or equal to 1.9 mm.

4. The power tool of claim 3, wherein the radius of the transition portion is equal to 1.9 mm.

* * * * *